US005829380A

United States Patent [19]

Smith

[11] Patent Number: 5,829,380

[45] Date of Patent: Nov. 3, 1998

[54] BOAT BOARDING SYSTEM FOR DOGS

[76] Inventor: Donald H. Smith, 206 Armstead Ct., Downingtown, Pa. 19335

[21] Appl. No.: 903,604

[22] Filed: Jul. 31, 1997

[51] Int. Cl.[6] ..... B63B 17/00

[52] U.S. Cl. ..... 114/362; 182/206

[58] Field of Search ..... 114/343, 362; 14/71.1, 71.3, 71.5, 71.7; 182/194, 206

[56] References Cited

U.S. PATENT DOCUMENTS

| | | | |
|---|---|---|---|
| 3,891,053 | 6/1975 | Burton | 114/362 |
| 4,724,925 | 2/1988 | Ritten | 114/362 |
| 5,123,372 | 6/1992 | Kobayashi et al. | 114/362 |

FOREIGN PATENT DOCUMENTS

| | | | |
|---|---|---|---|
| 2752289 | 5/1979 | Germany | 114/362 |

*Primary Examiner*—Jesus D. Sotelo

[57] ABSTRACT

A new Boat boarding system for dogs for ALLOWING PETS TO SAFELY AND EASILY EXIT AND ENTER A BOAT. The inventive device includes a folding platform comprising a pair of platform segments hingedly secured together in a linear arrangement. The pair of platform segments include an inner segment and an outer segment. A free end of the inner segment is secured to a boat. A pair of inflatable floatation bags are positioned on an underside of the outer segment disposed inwardly of a free end thereof.

8 Claims, 2 Drawing Sheets

BOAT BOARDING SYSTEM FOR DOGS

BACKGROUND OF THE INVENTION

1. Field of the Invention

The present invention relates to BOAT LADDERS and more particularly pertains to a new BOAT BOARDING SYSTEM FOR DOGS for ALLOWING PETS TO SAFELY AND EASILY EXIT AND ENTER A BOAT.

2. Description of the Prior Art

The use of BOAT LADDERS is known in the prior art. More specifically, BOAT LADDERS heretofore devised and utilized are known to consist basically of familiar, expected and obvious structural configurations, notwithstanding the myriad of designs encompassed by the crowded prior art which have been developed for the fulfillment of countless objectives and requirements.

Known prior art BOAT LADDERS include U.S. Pat. No. 5,123,372 to Kobayashi et al.; U.S. Pat. No. 3,891,053 to Burton; U.S. Pat. No. 4,724,925 to Ritten; U.S. Pat. No. 4,799,447 to Hebert et al.; U.S. Pat. No. 4,186,820 to Cosman et al.; and U.S. Pat. No. Des. 334,731 to McCarty.

While these devices fulfill their respective, particular objectives and requirements, the aforementioned patents do not disclose a new Boat boarding system for dogs. The inventive device includes a folding platform comprising a pair of platform segments hingedly secured together in a linear arrangement. The pair of platform segments include an inner segment and an outer segment. A free end of the inner segment is secured to a boat. A pair of inflatable floatation bags are positioned on an underside of the outer segment disposed inwardly of a free end thereof.

In these respects, the Boat boarding system for dogs according to the present invention substantially departs from the conventional concepts and designs of the prior art, and in so doing provides an apparatus primarily developed for the purpose of ALLOWING PETS TO SAFELY AND EASILY EXIT AND ENTER A BOAT.

SUMMARY OF THE INVENTION

In view of the foregoing disadvantages inherent in the known types of BOAT LADDERS now present in the prior art, the present invention provides a new Boat boarding system for dogs construction wherein the same can be utilized for ALLOWING PETS TO SAFELY AND EASILY EXIT AND ENTER A BOAT.

The general purpose of the present invention, which will be described subsequently in greater detail, is to provide a new Boat boarding system for dogs apparatus and method which has many of the advantages of the BOAT LADDERS mentioned heretofore and many novel features that result in a new Boat boarding system for dogs which is not anticipated, rendered obvious, suggested, or even implied by any of the prior art BOAT LADDERS, either alone or in any combination thereof.

To attain this, the present invention generally comprises a folding platform comprising a pair of platform segments hingedly secured together in a linear arrangement. The pair of platform segments include an inner segment and an outer segment. A free end of the inner segment is secured to a drop ladder of a boat. Each of the platform segments include a pair of opposed vertical supports. A central region is disposed between the vertical supports. The central region has a non-slip surface disposed thereon. The central region has a plurality of horizontal supports extending upwardly therefrom in a spaced relationship. The horizontal supports extend between the pair of vertical supports. Each of the platform segments has a pair of grasping apertures through the central region inwardly of free ends thereof. A pair of inflatable floatation bags are positioned on an underside of the opposing vertical supports of the outer segment disposed inwardly of the free end thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Boat boarding system for dogs apparatus and method which has many of the advantages of the BOAT LADDERS mentioned heretofore and many novel features that result in a new Boat boarding system for dogs which is not anticipated, rendered obvious, suggested, or even implied by any of the prior art BOAT LADDERS, either alone or in any combination thereof.

It is another object of the present invention to provide a new Boat boarding system for dogs which may be easily and efficiently manufactured and marketed.

It is a further object of the present invention to provide a new Boat boarding system for dogs which is of a durable and reliable construction.

An even further object of the present invention is to provide a new Boat boarding system for dogs which is susceptible of a low cost of manufacture with regard to both materials and labor, and which accordingly is then susceptible of low prices of sale to the consuming public, thereby making such Boat boarding system for dogs economically available to the buying public.

Still yet another object of the present invention is to provide a new Boat boarding system for dogs which provides in the apparatuses and methods of the prior art some of the advantages thereof, while simultaneously overcoming some of the disadvantages normally associated therewith.

Still another object of the present invention is to provide a new Boat boarding system for dogs for ALLOWING PETS TO SAFELY AND EASILY EXIT AND ENTER A BOAT.

Yet another object of the present invention is to provide a new Boat boarding system for dogs which includes a folding platform comprising a pair of platform segments hingedly secured together in a linear arrangement. The pair of platform segments include an inner segment and an outer segment. A free end of the inner segment is secured to a boat. A pair of inflatable floatation bags are positioned on an underside of the outer segment disposed inwardly of a free end thereof.

Still yet another object of the present invention is to provide a new Boat boarding system for dogs that is stabilized slightly below the water level.

Even still another object of the present invention is to provide a new Boat boarding system for dogs that features small ridge to aid in footing by the pet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
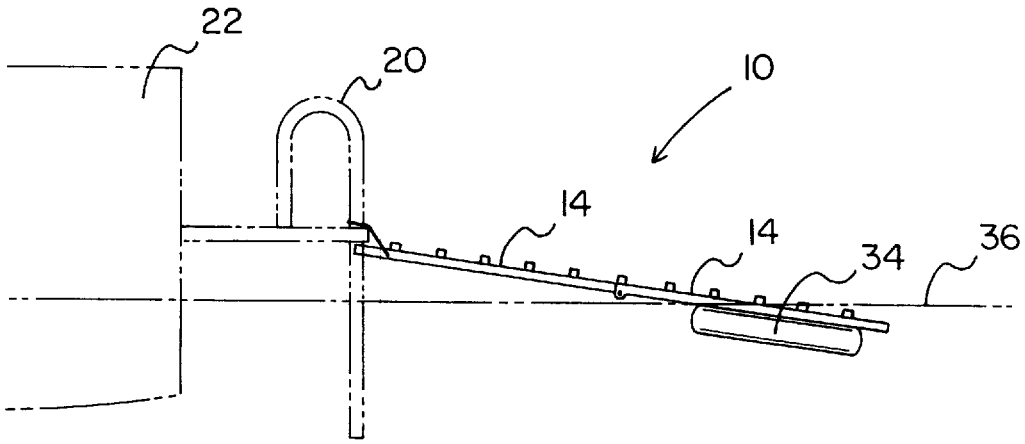
FIG. 1 is a side elevation view of a new Boat boarding system for dogs according to the present invention.
Figure 2:
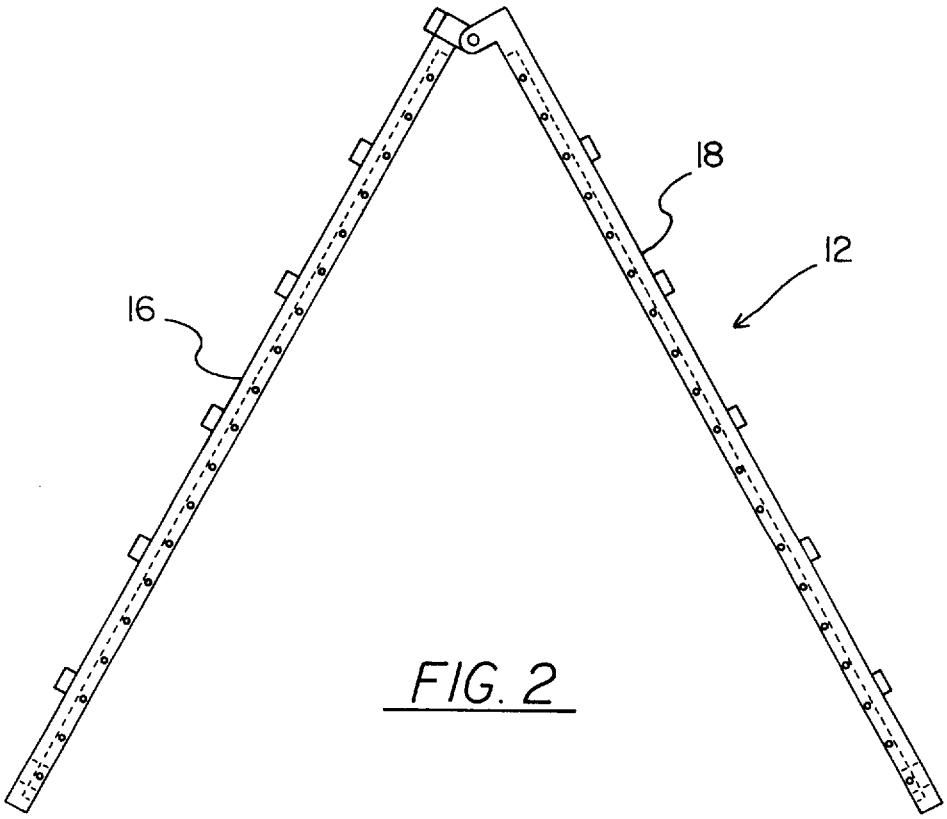
FIG. 2 is a side view of the folding platform of the present invention.
Figure 3:
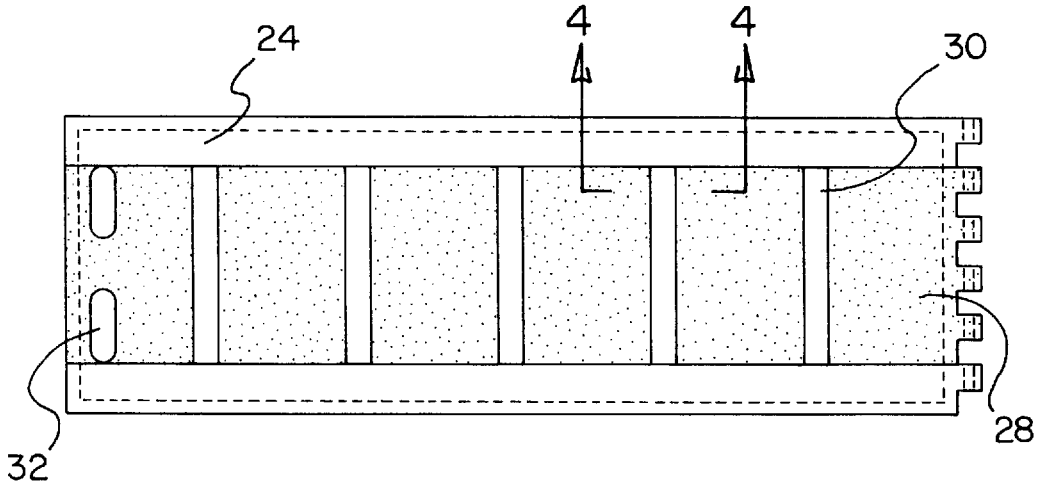
FIG. 3 is a plan view of the folding platform of the present invention.
Figure 5:
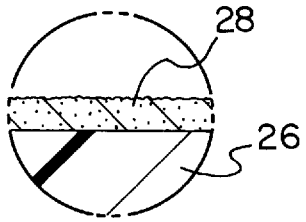
FIG. 5 is a enlarged view of the portion of FIG. 4 within the circle labeled "5".
Figure 4:
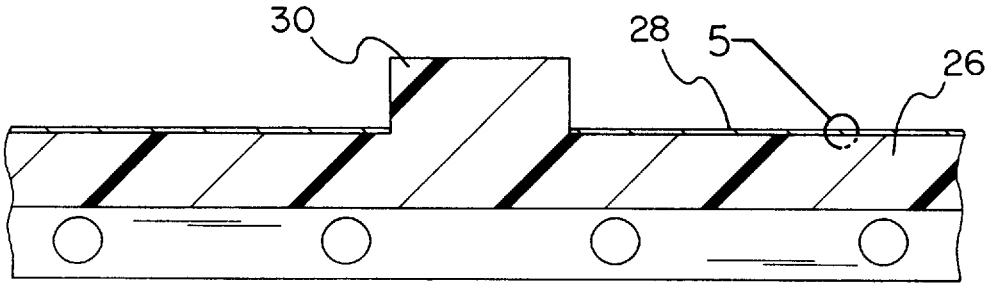
FIG. 4 is a cross-sectional view of the present invention as taken along line 4—4 of FIG. 3.

With reference now to the drawings, and in particular to FIGS. 1 through 4 thereof, a new Boat boarding system for dogs embodying the principles and concepts of the present invention and generally designated by the reference numeral 10 will be described.

As best illustrated in FIGS. 1 through 4, the Boat boarding system for dogs 10 comprises a folding platform 12 comprising a pair of platform segments 14 hingedly secured together in a linear arrangement. The pair of platform segments 14 include an inner segment 16 and an outer segment 18. A free end of the inner segment 16 is secured to a drop ladder 20 of a boat 22. Each of the platform segments 14 include a pair of opposed vertical supports 24. A central region 26 is disposed between the vertical supports 24. The central region 26 has a non-slip surface 28 disposed thereon. The central region 26 has a plurality of horizontal supports 30 extending upwardly therefrom in a spaced relationship. The horizontal supports 30 extend between the pair of vertical supports 24. Each of the platform segments 14 has a pair of grasping apertures 32 through the central region 28 inwardly of free ends thereof.

A pair of inflatable floatation bags 34 are positioned on an underside of the opposing vertical supports 24 of the outer segment 18 disposed inwardly of the free end thereof.

In use, the device 10 is a floating platform 12 that would allow pets to safely and more easily exit and enter a boat. The present invention is essentially constructed of a rigid plastic material and measures six feet in length and is one foot wide. The inflatable floatation bags 34 stabilize the device 10 slightly below the water level 36, as illustrated in FIG. 1. The inner segment 16 is mounted to a ladder 20 or an edge of the boat by means of a clamping device or another mounting bracket. The device 10 includes a non-slip surface 28 and the horizontal segments 30 serve as ridges to aid in footing by the pet while deterring adults from using the device 10. The flotation bags 34 can be adjusted according to the size and weight of the dog. As the dog steps onto the device 10, it would sink into the water, thus allowing the dog to easily step onto the end of the outer segment 18 and walk the length of the platform 12 and onto the boat 22. Additionally, the device 10 could also be constructed for use on docks.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boat boarding system for dogs for allowing pets to safely and easily exit and enter a boat comprising, in combination:

a folding platform comprising a pair of platform segments hingedly secured together in a linear arrangement, the pair of platform segments including an inner segment and an outer segment, a free end of the inner segment secured to a drop ladder of a boat, each of the platform segments including a pair of opposed vertical supports, a central region disposed between the vertical supports, the central region having a non-slip surface disposed thereon, the central region having a plurality of horizontal supports extending upwardly therefrom in a spaced relationship, the horizontal supports extending between the pair of vertical supports, each of the platform segments having a pair of grasping apertures through the central region inwardly of free ends thereof; and a pair of inflatable floatation bags positioned on an underside of the opposing vertical supports of the outer segment disposed inwardly of the free end thereof.

2. A boat boarding system for dogs for allowing pets to safely and easily exit and enter a boat comprising, in combination:

a folding platform comprising a pair of platform segments hingedly secured together in a linear arrangement, the pair of platform segments including an inner segment and an outer segment, a free end of the inner segment secured to a boat;

a pair of inflatable floatation bags positioned on an underside of the outer segment disposed inwardly of a free end thereof; and wherein each of the platform segments includes a pair of opposed vertical supports, a central region disposed between the vertical supports.

3. The boat boarding system as set forth in claim 2 wherein the central region has a non-slip surface disposed thereon.

4. The boat boarding system as set forth in claim 3 wherein the central region has a plurality of horizontal supports extending upwardly therefrom in a spaced relationship, the horizontal supports extending between the pair of vertical supports.

5. A boat boarding system for dogs for allowing pets to safely and easily exit and enter a boat comprising, in combination:

a folding platform comprising a pair of platform segments hingedly secured together in a linear arrangement, the pair of platform segments including an inner segment and an outer segment, a free end of the inner segment secured to a boat;

a pair of inflatable floatation bags positioned on an underside of the outer segment disposed inwardly of a free end thereof; and wherein each of the platform segments has a pair of grasping apertures therethrough inwardly of free ends thereof.

6. The boat boarding system as set forth in claim 5 wherein each of the platform segments includes a pair of opposed vertical supports, a central region disposed between the vertical supports.

7. The boat boarding system as set forth in claim 6 wherein the central region has a non-slip surface disposed thereon.

8. The boat boarding system as set forth in claim 7 wherein the central region has a plurality of horizontal supports extending upwardly therefrom in a spaced relationship, the horizontal supports extending between the pair of vertical supports.

* * * * *